US008719996B1

(12) United States Patent
Brauns et al.

(10) Patent No.: US 8,719,996 B1
(45) Date of Patent: May 13, 2014

(54) SYSTEMS AND METHODS FOR CLEANING AND CONDITIONING A MOVING SURFACE

(75) Inventors: Allen Brauns, Sturbridge, MA (US); Royal Gauvin, Windham, ME (US); Robert Johnson, Sutton, MA (US); Normand Boucher, Laval (CA)

(73) Assignee: Kadant, Inc., Westford, MA (US)

( * ) Notice: Subject to any disclaimer, the term of this patent is extended or adjusted under 35 U.S.C. 154(b) by 1064 days.

(21) Appl. No.: 12/332,668

(22) Filed: Dec. 11, 2008

Related U.S. Application Data

(60) Provisional application No. 61/007,400, filed on Dec. 11, 2007.

(51) Int. Cl.
*B21B 1/28* (2006.01)
*A46B 15/00* (2006.01)

(52) U.S. Cl.
USPC ..... 15/256.51; 15/345; 15/301

(58) Field of Classification Search
USPC ..... 15/256.5, 256.1, 301, 393, 396, 403, 15/345, 375; 101/423–425; 162/199, 272
See application file for complete search history.

(56) References Cited

U.S. PATENT DOCUMENTS

| | | | | | |
|---|---|---|---|---|---|
| 955,467 | A * | 4/1910 | Moorhead | 15/330 |
| 1,575,939 | A * | 3/1926 | Satterwhite et al. | 15/396 |
| 2,240,005 | A * | 4/1941 | Moyer | 15/396 |
| 2,255,271 | A * | 9/1941 | Rast | 15/395 |
| 2,499,933 | A * | 3/1950 | Smul | 451/522 |
| 2,827,060 | A * | 3/1958 | Marty | 132/212 |
| 3,195,166 | A * | 7/1965 | Wisner | 15/321 |
| 4,202,140 | A * | 5/1980 | Alessio | 451/527 |
| 4,937,984 | A * | 7/1990 | Taranto | 451/524 |
| 5,428,865 | A * | 7/1995 | Yarbrough | 15/353 |
| 5,603,775 | A * | 2/1997 | Sjoberg | 134/21 |
| 5,644,986 | A * | 7/1997 | Gydesen | 101/424 |
| 5,657,693 | A * | 8/1997 | Kumaki et al. | 101/424 |
| 6,418,587 | B1 * | 7/2002 | Kent et al. | 15/322 |
| 6,568,024 | B2 * | 5/2003 | Kent et al. | 15/322 |
| 6,752,876 | B2 * | 6/2004 | Jenkins | 134/21 |
| 6,988,940 | B1 * | 1/2006 | Taylor | 451/354 |
| 2005/0177971 | A1 * | 8/2005 | Porco | 15/256.51 |
| 2005/0223926 | A1 * | 10/2005 | Baeten | 101/425 |

* cited by examiner

*Primary Examiner* — Lee D Wilson
*Assistant Examiner* — Tyrone V Hall, Jr.
(74) *Attorney, Agent, or Firm* — Gesmer Updegrove LLP

(57) ABSTRACT

A cleaning apparatus is disclosed for processing a moving surface. The cleaning apparatus includes a pad that is attached to a support structure, wherein the pad includes a plurality of pad apertures and the support structure includes a plurality of support structure apertures. A vacuum is provided proximate the plurality of support structure apertures for removing debris from a moving surface during use as well as for facilitating cooling of the pad during use.

26 Claims, 9 Drawing Sheets

SYSTEMS AND METHODS FOR CLEANING AND CONDITIONING A MOVING SURFACE

PRIORITY

The present application claims priority to U.S. Provisional Patent Application Ser. No. 61/007,400 filed Dec. 11, 2007.

BACKGROUND

The invention generally relates to roll cleaning apparatus for web or sheet production processes, and relates in particular, to roll cleaning apparatus for rolls in papermaking machines and web converting machines.

In a papermaking machine, web converting operation, or any other web or sheet production process it is often necessary to clean and/or condition the rotating roll surfaces or other moving surfaces that are used to convey the product. Inadequate cleaning of these moving surfaces will result in a build-up of contaminants and debris that may lead to product defects and production losses.

The contaminants that build up on these moving surfaces may include adhesive residue from use of recycled fiber, pitch, precipitated calcium carbonate (PCC), clay, starch or other polymers from coatings used in the product. Prior art cleaning systems generally utilized to remove contaminants on these moving surfaces include doctoring systems as well as abrasive pad type cleaning systems.

The doctor systems used for cleaning a roll generally employ a doctor blade to scrape the moving surface of a roll. Such doctor blades are generally effective in removing water, fiber build up and the product itself during threading or when a sheet break occurs. Doctor blades are also generally effective at removing contaminants of some appreciable thickness which allows the working edge of the blade can get underneath and lift the contaminant away from the moving surface. Such doctor blades however, are not typically very effective at removing contaminants (or haze) that is of a very small particle size and may be in the microscopic grooves or pores of the roll surface. Additionally, doctor blades are not typically very effective at removing contaminants of minimal thickness (<0.010 inches) and that are adhered to the moving surface with a very high bond strength.

Other prior art cleaning systems include a device that applies an abrasive pad against a moving surface such as a roll surface. United States Published Patent Application Publication No. 2005/0177971, for example, discloses an apparatus for cleaning a roll in a papermaking machine, wherein a cleaning pad that conforms to the surface of a roll is mounted on a movable support structure that is movable into engagement with the roll surface. FIG. 1, for example, shows an embodiment that includes a scrubbing element 10 attached to a backing member 12, which in turn is attached to brackets 14 via fasteners 16. A longitudinal motion drive 18 is employed to move the brackets 14 via bearings 20 mounted on a block 22 in a reciprocal scrubbing motion. The drive 18 and block 22 are mounted on a movable plate 24 that is moveable with respect to a base plate 26 about a pin 28 via actuation of pneumatic bellows 30 such that the scrubbing element 10 is moved through a gap G into and out of engagement with a surface of a roll 32. The position of the base plate 26 is bounded by a standoff 34 and a stop 36.

FIG. 2 shows another embodiment of a prior art cleaning pad and backing member also disclosed in United States Published Patent Application Publication No. 2005/0177971 that provides vacuum pressure near the roll surface. In particular, FIG. 2 shows a cleaning head assembly that has a backing member 40, which provides an internal plenum 42, and a roll engagement wall 44 to which an abrasive pad 46 is attached via fasteners 48 and 50. The wall 44 is disclosed to include grooves 52, 54, 56, 58, 60, 62 as well as apertures therein through which dust and lint particles are disclosed to be drawn by vacuum into the plenum 42 and exhausted from the cleaning apparatus. One end of the plenum 42 is capped while the other end is coupled to a vacuum line, or both ends may be coupled to vacuum lines.

Areas of air restrictions in such vacuum systems typically result in large pressure drops, which greatly limit the air flow and therefore the capacity to effectively convey dust and contaminants to a collection point. Such systems also may have difficulties with dust and contaminants building up and plugging internal air passages in the equipment. The ability of the abrasive pad to clean and condition a moving surface is greatly reduced once contaminants build up on the pad's working surface because the build-up of contaminants on the abrasive pad working surface creates a barrier between the abrasive particles and the moving surface making the abrasive particle ineffective. Additionally, the moving surface, or roll surface, is often operated at a very high temperature (150° to 550° F.) and additional heat is generated by friction between the abrasive pad and the moving surface. As a consequence, the working lives of the abrasive pads are often too short due to exposure to process temperatures that exceed the capacity of the abrasive pad substrate material to withstand heat at such temperatures.

There is a need therefore, for a roll or web cleaning system that provides reduced build-up of debris during cleaning, and that provides improved operational life at high temperatures.

SUMMARY

The invention provides a cleaning apparatus for processing a moving surface. In accordance with an embodiment, the cleaning apparatus includes a pad that is attached to a support structure, wherein the pad includes a plurality of pad apertures and the support structure includes a plurality of support structure apertures. A vacuum is provided proximate the plurality of support structure apertures for removing debris from a moving surface during use as well as for facilitating cooling of the pad during use.

In accordance with another embodiment, the cleaning apparatus includes at least two pads that are attached to a support structure, wherein the at least two pads are attached to the support structure such that the pads provide a gap therebetween, and the support structure includes an opening proximate the gap. A vacuum is provided proximate support structure opening for removing debris from a moving surface during use as well as for facilitating cooling of the pad during use.

In accordance with a further embodiment, the cleaning apparatus includes a pad that is attached to a support structure, wherein said pad includes a plurality of pad apertures and the support structure includes a plurality of support structure apertures. The pad apertures are substantially aligned with the support structure apertures when the pad is mounted on the support structure for facilitating the removal of debris from a moving surface during use as well as for facilitating cooling of the pad during use.

In accordance with yet a further embodiment, the cleaning apparatus includes at least one pad that is attached to a support structure, and further includes pressurized fluid means for providing a fluid to the at least one pad for facilitating the removal of debris from a moving surface during use as well as for facilitating cooling of the pad during use.

BRIEF DESCRIPTION OF THE ILLUSTRATED EMBODIMENTS

The following description may be further understood with reference to the accompanying drawings in which:

FIGS. 8A and 8B show diagrammatic illustrative plan and side views of a support shoe for use with the cleaning pad shown in FIGS. 7A and 7B;

The drawings are shown for illustrative purposes only.

DETAILED DESCRIPTION OF THE ILLUSTRATED EMBODIMENTS

The invention generally provides improvements in cleaning apparatus that are employed in contact with a rotating roll or other moving surface to clean and/or condition the surface. Applicants have found that increasing the air flow through an abrasive pad is desirable since it helps prolong the abrasive pad life by facilitating cooling of the pad. Increased air flow will also help to keep the abrasive pad cleaner, and more effective at cleaning and conditioning the moving surface for a longer period of time. A cleaning pad used in an embodiment of the invention, for example, may consist of a non-woven synthetic, natural fiber or metallic substrate to which abrasive particles are bonded. Various types and sizes of abrasive particles can be used depending on the application requirements. For example, Aluminum Oxide, Ceramic Aluminum Oxide, Silicon Carbide, Tungsten Carbide and Zirconia Alumina may be used as abrasive particles.

The cleaning device and components described below may be used to clean rotating roll surfaces or any other moving surface that is used to convey a web or sheet type product. This invention and its embodiments are also suitable for use in applications wherein the moving surface being cleaned or treated is the product itself. For example, metal processing lines may require that the product surface itself be cleaned and/or conditioned. As used herein, the term moving surface is used to represent all of these various applications.

Figure 1:
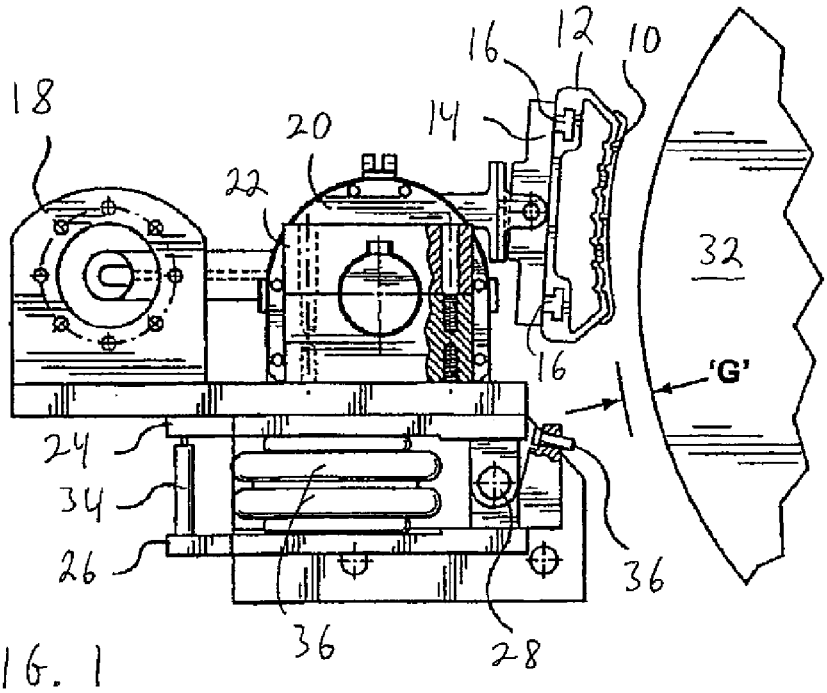
FIG. 1 PRIOR ART
FIG. 1 shows a diagrammatic illustrative side view of a roll cleaning apparatus of the prior art employing a cleaning pad.
Figure 2:
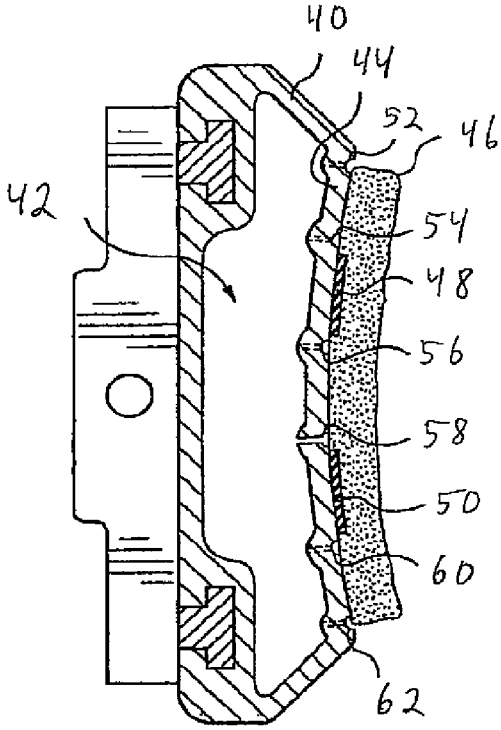
FIG. 2 PRIOR ART
FIG. 2 shows a diagrammatic illustrative side view of a portion of another roll cleaning apparatus of the prior art employing a cleaning pad and vacuum assisted debris removal.
Figure 3A:
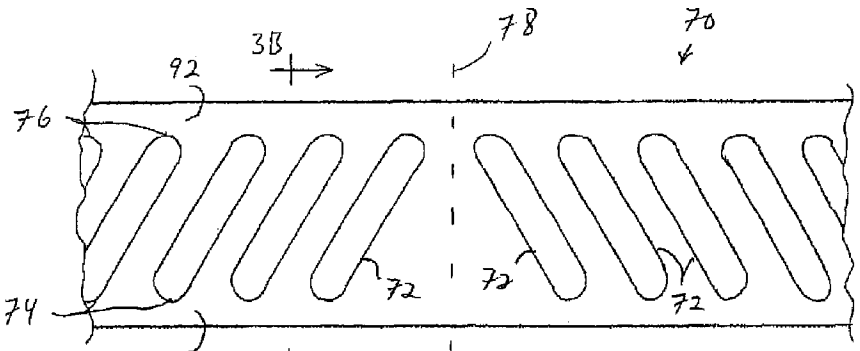
FIGS. 3A and 3B show diagrammatic illustrative plan and side views of a cleaning pad in accordance with an embodiment of the invention.
Figure 3B:
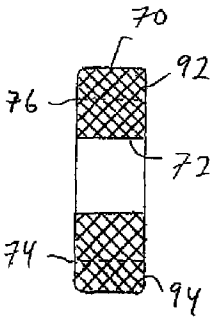

FIG. 3A shows a plan view of an abrasive pad 70 in accordance with an embodiment of the invention, and FIG. 3B shows a side sectional view thereof taken along line 3B-3B of FIG. 3A. The pad 70 includes shaped apertures 72, each of which has a shape of an oval. The oval shaped apertures 72 are positioned at an angle of from about 10 to 70 degrees from vertical, and preferably from about 20 to 40 degrees from vertical and more preferably about 30 degrees from vertical. The oval-shaped apertures may extend from a lower portion 74 to an upper portion 76 as shown. The apertures 72 may also be symmetric about a centerline 78 of the pad as shown. As a roll rotates, a substantial portion of the roll will pass at least a portion of one aperture 72.

Figure 4A:
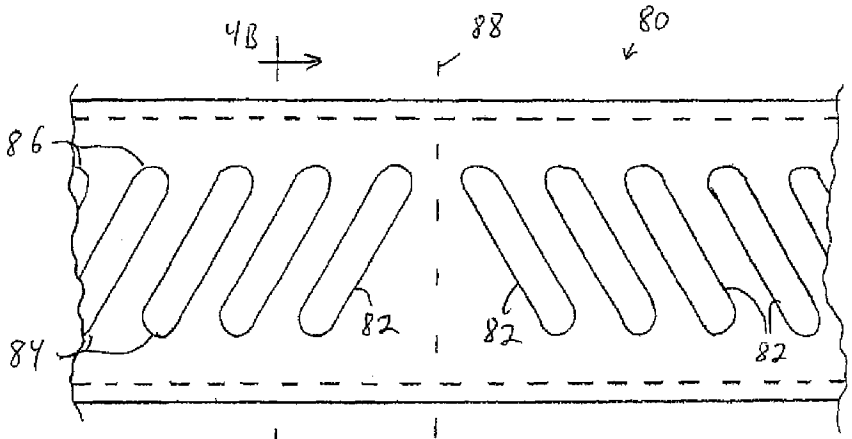
FIGS. 4A and 4B show diagrammatic illustrative plan and side views of a support shoe for use with the cleaning pad shown in FIGS. 3A and 3B.
Figure 4B:
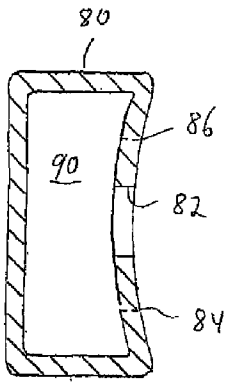

FIG. 4A shows a plan view of a shoe 80 that may be used with the pad 70 of FIGS. 3A and 3B in accordance with an embodiment of the invention, and FIG. 4B shows a side sectional view thereof taken along line 4B-4B of FIG. 4A. The shoe 80 includes shaped apertures 82, each of which also has a shape of an oval. The oval shaped apertures 82 are also positioned at an angle of from about 10 to 70 degrees from vertical, and preferably from about 20 to 40 degrees from vertical and more preferably about 30 degrees from vertical. The oval-shaped apertures may extend from a lower portion 84 to an upper portion 86 as shown, and the apertures 82 may also be symmetric about a centerline 88 of the pad as shown. During use, the pad 70 may be attached to the shoe 80 (e.g., by adhesive or Velcro or other conventional fashioning means) such that the apertures 72 of the pad 70 align with the apertures 82 of the shoe 80. In further embodiments, the amount of alignment of the apertures may be adjusted from 100% down to no alignment of the apertures as may be suitable for any specific desired amount of cooling and debris removal.

The shoe 80 further includes an internal plenum 90 that is coupled to a vacuum line to provide vacuum through the apertures 82 of the shoe 80 and through the mutually aligned apertures 72 of the pad 70. One end of the shoe 80 is coupled to a vacuum line and one end may be capped, or both ends of the shoe 80 may be coupled to a common vacuum line or to two vacuum lines. In some embodiments, the ends of the pad may be covered with a flexible material that is closed to gas (e.g., a closed cell foam material), or in further embodiments the ends of the pad may be open or partially open as desired for specific cooling needs in certain applications. The pad and shoe arrangement of these embodiments of the invention provide debris removal during cleaning as well as a desired amount of cooling.

The pad and shoe arrangement of FIGS. 3A, 3B, 4A and 4B provide for increased air flow thus extending pad life and increasing pad cleaning effectiveness. The abrasive pad 70 provides a sufficient amount of abrasive material located along the upper and lower edges, shown as 92 and 94, to effectively clean and condition the moving surface. The apertures are placed in the center of the abrasive pad to minimize the resistance for the air flow and contaminant particles. Once the contaminant particles are released from the moving surface, it is desired in certain embodiments to have the particles accelerate into motion and migrate through the pad and through the pad support shoe as quickly and as efficiently as possible.

Figure 5A:
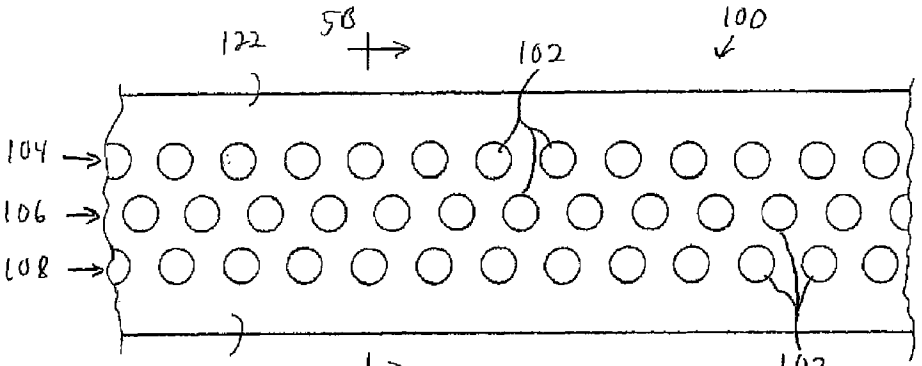
FIGS. 5A and 5B show diagrammatic illustrative plan and side views of a cleaning pad in accordance with another embodiment of the invention.
Figure 5B:
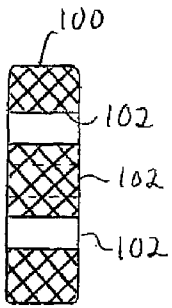
Figure 6A:
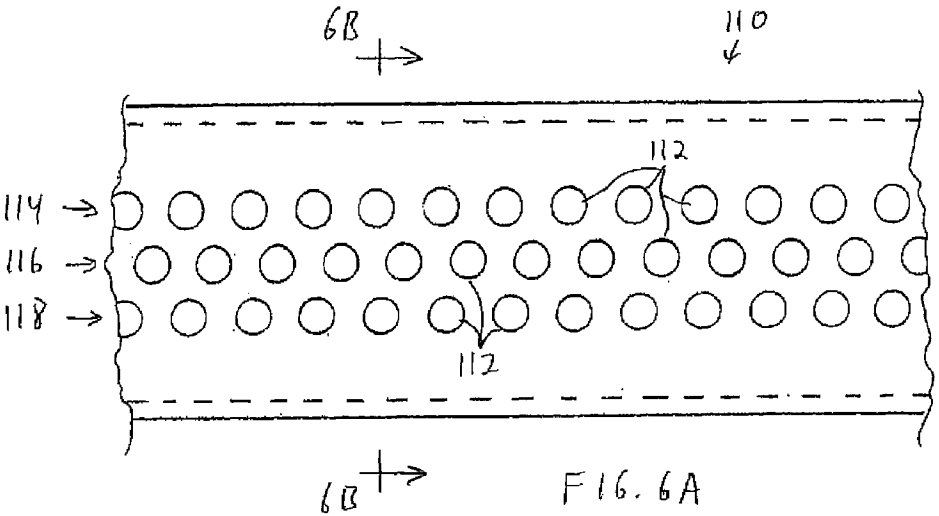
FIGS. 6A and 6B show diagrammatic illustrative plan and side views of a support shoe for use with the cleaning pad shown in FIGS. 5A and 5B.
Figure 6B:
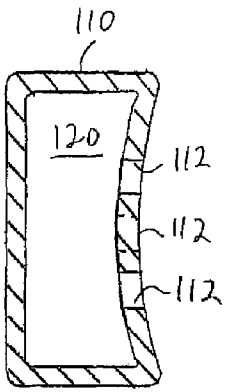

FIG. 5A shows a plan view of an abrasive pad 100 in accordance with another embodiment of the invention, and FIG. 5B shows a side sectional view thereof taken along line 5B-5B of FIG. 5A. The pad 100 includes circularly shaped apertures 102 that are arranged in staggered rows (shown at 104, 106, 108) such that as a roll rotates, a substantial portion of the roll should pass by at least one aperture. FIG. 6A shows a plan view of a shoe 110 that may be used with the pad 100 of FIGS. 5A and 5B in accordance with an embodiment of the invention, and FIG. 6B shows a side sectional view thereof taken along line 6B-6B of FIG. 6A. The shoe 110 also includes circularly shaped apertures 112 that are arranged in staggered rows (shown at 114, 116, 118). During use, the pad 100 may be attached to the shoe 110 (e.g., by adhesive or Velcro or other conventional fashioning means) such that the apertures 102 of the pad 100 align with the apertures 112 of the shoe 110. In further embodiments, the amount of alignment of the apertures may be adjusted from 100% down to no alignment of the apertures as may be suitable for any specific desired amount of cooling and debris removal.

The shoe 110 further includes an internal plenum 120 that is coupled to a vacuum line to provide vacuum through the apertures 112 of the shoe 110 and through the mutually aligned apertures 102 of the pad 100. One end of the shoe 110 is coupled to a vacuum line and one end may be capped, or both ends of the shoe 110 may be coupled to a common vacuum line or to two vacuum lines. In some embodiments, the ends of the pad may be covered with a flexible material that is closed to gas (e.g., a closed cell foam material), or in further embodiments the ends of the pad may be open or partially open as desired for specific cooling needs in certain applications. The pad and shoe arrangement of these embodiments of the invention also provide debris removal during cleaning as well as a desired amount of cooling.

The pad and shoe arrangement of FIGS. 5A, 5B, 6A and 6B provide for increased air flow thus extending pad life and increasing pad cleaning effectiveness. The abrasive pad 100 provides a sufficient amount of abrasive material located along the upper and lower edges, shown as 122 and 124, to effectively clean and condition the moving surface. The apertures are placed in the center of the abrasive pad to minimize the resistance for the air flow and contaminant particles. Once the contaminant particles are released from the moving surface, it is desired in certain embodiments to have the particles accelerate into motion and migrate through the pad and through the pad support shoe as quickly and as efficiently as possible.

Figure 7A:
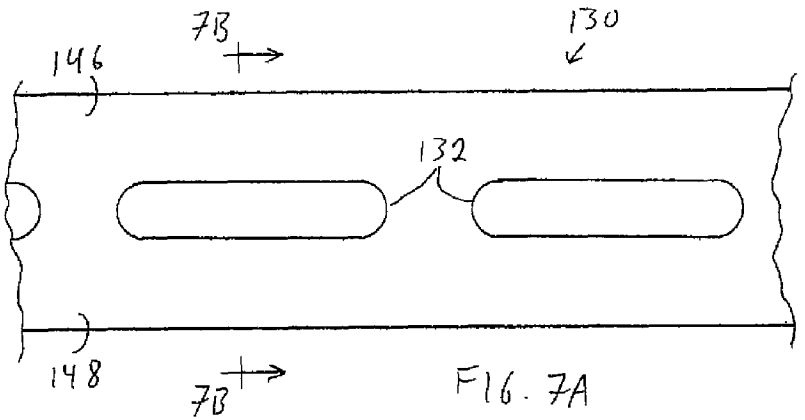
FIGS. 7A and 7B show diagrammatic illustrative plan and side views of a cleaning pad in accordance with a further embodiment of the invention.
Figure 7B:
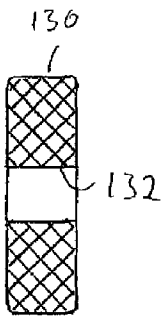
Figure 8A:
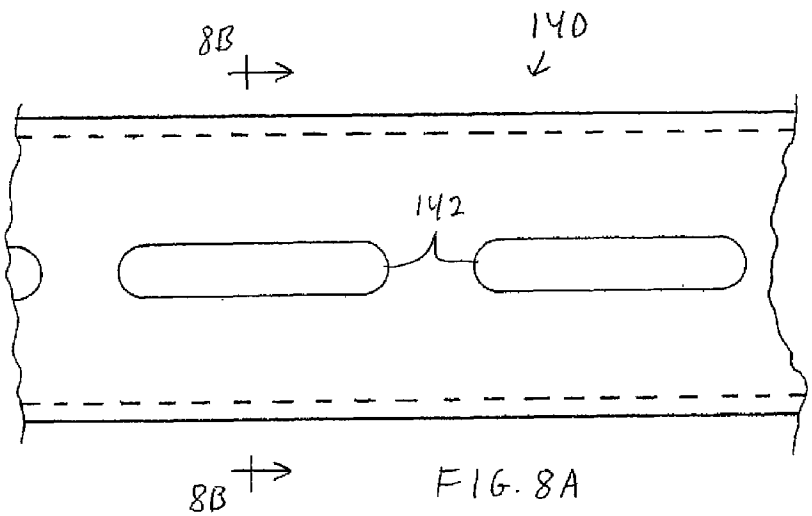
Figure 8A:
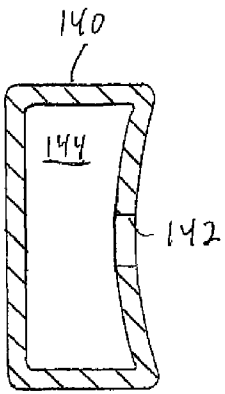

FIG. 7A shows a plan view of an abrasive pad 130 in accordance with another embodiment of the invention, and FIG. 7B shows a side sectional view thereof taken along line 7B-7B of FIG. 7A. The pad 130 includes oval shaped apertures 132 that are arranged in a horizontal line along the central region of the pad 130 such that as a roll rotates, a substantial portion of the roll should pass by at least one aperture. FIG. 8A shows a plan view of a shoe 140 that may be used with the pad 130 of FIGS. 7A and 7B in accordance with an embodiment of the invention, and FIG. 8B shows a side sectional view thereof taken along line 8B-8B of FIG. 8A. The shoe 140 also includes oval shaped apertures 142 that are arranged in a horizontal line along the central region of the pad 130. During use, the pad 130 may be attached to the shoe 140 (e.g., by adhesive or Velcro or other conventional fashioning means) such that the apertures 132 of the pad 130 align with the apertures 142 of the shoe 140. In further embodiments, the amount of alignment of the apertures may be adjusted from 100% down to no alignment of the apertures as may be suitable for any specific desired amount of cooling and debris removal.

The shoe 140 further includes an internal plenum 144 that is coupled to a vacuum line to provide vacuum through the apertures 142 of the shoe 140 and through the mutually aligned apertures 132 of the pad 130. One end of the shoe 140 is coupled to a vacuum line and one end may be capped, or both ends of the shoe 140 may be coupled to a common vacuum line or to two vacuum lines. In some embodiments, the ends of the pad may be covered with a flexible material that is closed to gas (e.g., a closed cell foam material), or in further embodiments the ends of the pad may be open or partially open as desired for specific cooling needs in certain applications. The pad and shoe arrangement of these embodiments of the invention also provide debris removal during cleaning as well as a desired amount of cooling.

The pad and shoe arrangement of FIGS. 7A, 7B, 8A and 8B provide for increased air flow thus extending pad life and increasing pad cleaning effectiveness. The abrasive pad 130 provides a sufficient amount of abrasive material located along the upper and lower edges, shown as 146 and 148, to effectively clean and condition the moving surface. The apertures are placed in the center of the abrasive pad to minimize the resistance for the air flow and contaminant particles. Once the contaminant particles are released from the moving surface, it is desired in certain embodiments to have the particles accelerate into motion and migrate through the pad and through the pad support shoe as quickly and as efficiently as possible.

Figure 9A:
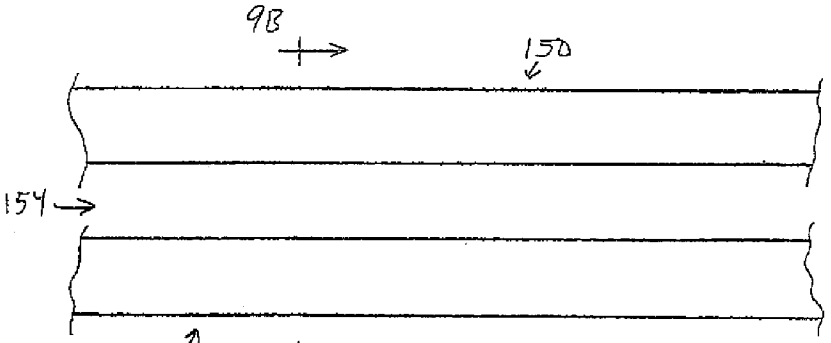
FIGS. 9A and 9B show diagrammatic illustrative plan and side views of a two piece cleaning pad in accordance with a further embodiment of the invention.
Figure 9B:
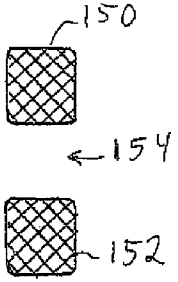
Figure 10A:
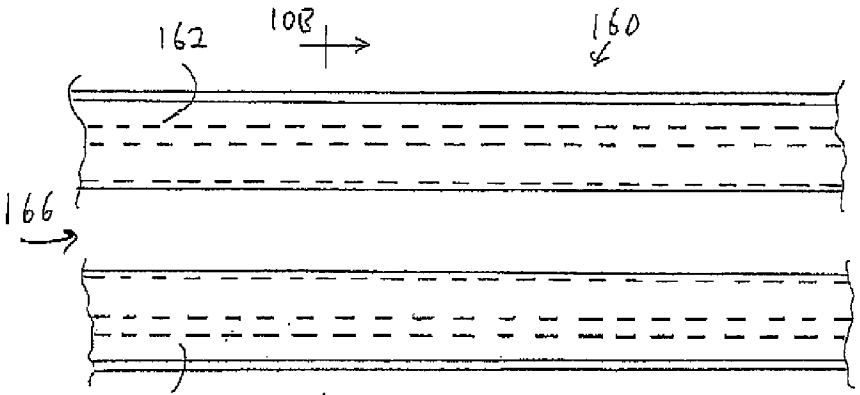
FIGS. 10A and 10B show diagrammatic illustrative plan and side views of a support shoe for use with the two piece cleaning pad shown in FIGS. 9A and 9B.
Figure 10B:
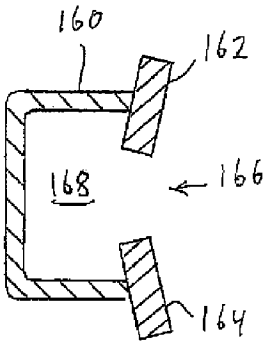

FIG. 9A shows a plan view of a pair of abrasive pads 150, 152 in accordance with another embodiment of the invention, and FIG. 9B shows a side sectional view thereof taken along 9B-9B of FIG. 9A. The pads 150, 152 are arranged to provide an opening 154 between them when mounted on a corresponding shoe such that as a roll rotates, a substantial portion of the roll should passes by the opening 154. FIG. 10A shows a plan view of a shoe 160 that may be used with the pads 150, 152 of FIGS. 9A and 9B in accordance with an embodiment of the invention, and FIG. 10B shows a side sectional view thereof taken along line 10B-10B of FIG. 10A. The shoe 160 includes pad mounting surfaces 162, 164 onto which the pads 150, 152 may be mounted (e.g., by adhesive of Velcro or other conventional fashioning means. The shoe 160 may further includes an internal plenum 168 that is coupled to a vacuum line to provide vacuum through an opening 166 of the shoe 160 as well as through the opening 154 of the pad 150. In this case, one end of the shoe 160 is coupled to a vacuum line and one end may be capped, or both ends of the shoe 160 may be coupled to a common vacuum line or to two vacuum lines. In some embodiments the ends of the pad may be covered with a flexible material that is closed to gas (e.g., a closed cell foam material), or in further embodiments the ends of the pad may be open or partially open as desired for specific cooling needs in certain applications. The pad and shoe arrangement of these embodiments of the invention also provide debris removal during cleaning as well as a desired amount of cooling.

The pad and shoe arrangement of FIGS. 9A, 9B, 10A and 10B provide for increased air flow thus extending pad life and increasing pad cleaning effectiveness. The abrasive pads 150, 152 provide a sufficient amount of abrasive material located along the upper and lower pads 150, 152 to effectively clean and condition the moving surface. Once the contaminant particles are released from the moving surface, it is desired in certain embodiments to have the particles accelerate into motion and migrate through the pad and through the pad support shoe as quickly and as efficiently as possible. When the moving surface is a roll or other curved surface, the upper and lower pad mounting surfaces may be of a concave shape and oriented to match the surface or, alternatively as shown in FIG. 10B, may be flat but oriented in an opposing manner to approximately match the radius of the roll or other curved surface.

Figure 11:
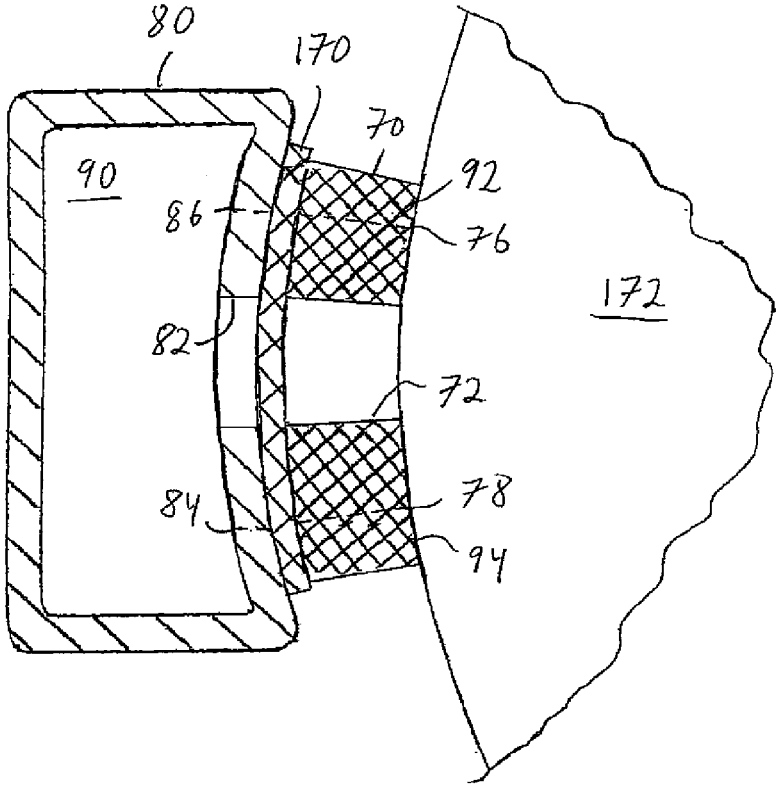
FIG. 11 shows a diagrammatic illustrative sectional side view of a cleaning pad and shoe as shown in FIGS. 3A and 3B together with an optional filter.

The increased air flow provided by the above embodiments contributes to longer pad life by cooling the pad substrate. It should be understood that the illustrations provide examples of the improved pad design and are not meant to limit the scope of the invention. The shoes of the above discussed embodiments provide a large amount of open area for air flow in the front face of the shoe while also providing adequate support for the pad to achieve even loading against the moving surface. Each of the above disclosed support shoes may be used with the associated pads, and in further embodiments, may be used with non-associated pads, and may further be used with conventional pads. In this latter case, the pad geometry may be selected in a manner that either causes the open area of the pad and shoe to be aligned or misaligned depending on the requirements of the application In further embodiments, it is possible to provide increased air flow and therefore cooling while also providing a desired filtration of the debris. FIG. 11 shows an illustrative side sectional view of the pad 70 and shoe 80 of FIGS. 3A, 3B, 4A and 4B used with a continuous filter material 170 on the entire back surface of the abrasive pad 70 to capture the contaminants and dust before entering the inside of the shoe 80 and downstream air passages. This arrangement is most valuable when the debris and dust being removed from the moving surface of the roll 172 is sticky and would otherwise have the tendency to plug up and block the air passages. The filter material 170 may be a non-woven filter material that is stitched on, or secured with adhesive, to the back surface of the abrasive pad.

Figure 12:
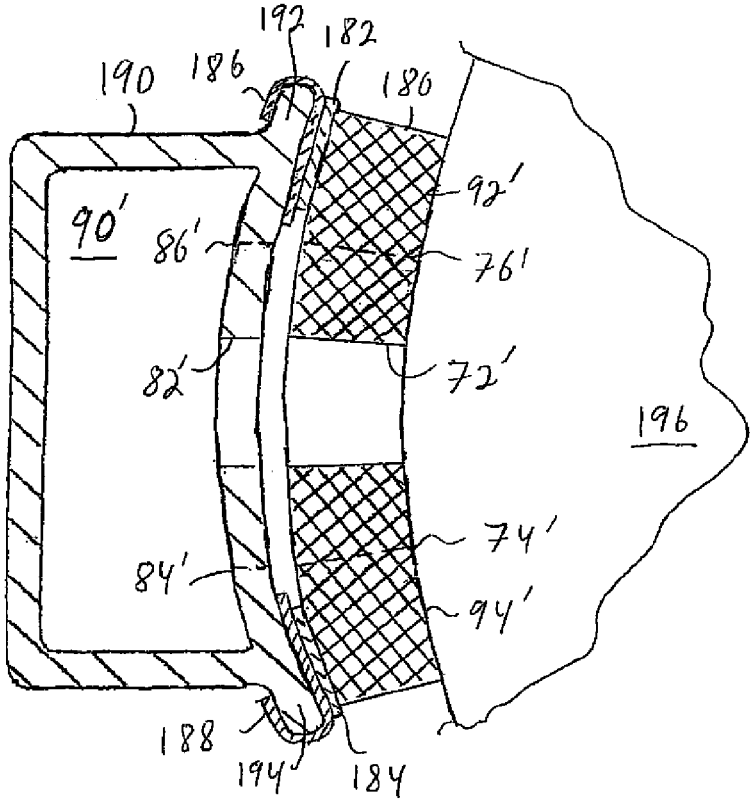
FIG. 12 shows a diagrammatic illustrative sectional side view of a cleaning pad and shoe in accordance with a further embodiment of the invention that provides a slide attachment structure.
Figure 13:
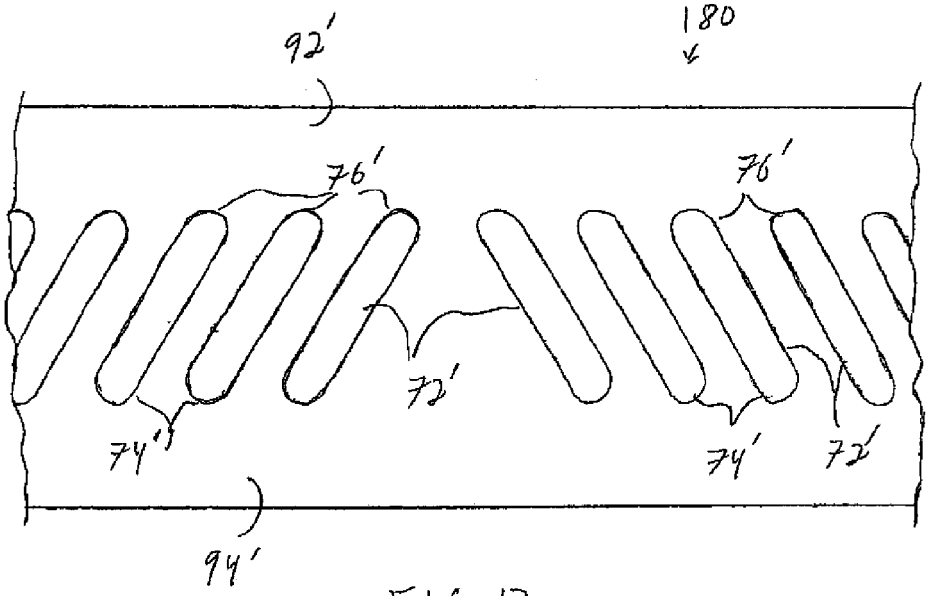
FIGS. 13 and 14 show diagrammatic illustrative plan views of the pad and shoe of FIG. 12.
Figure 14:
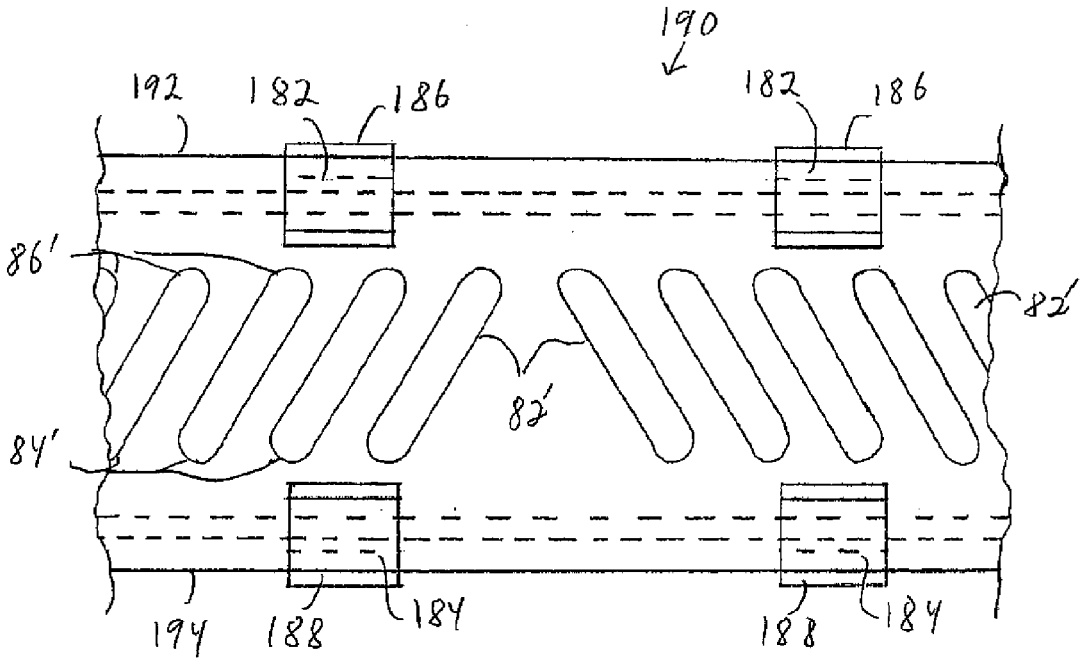

FIGS. 12, 13 and 14 show a cleaning pad and shoe arrangement in accordance with a further embodiment of the invention in which a pad 180 similar to the pad of FIGS. 3A and 3B is used except that amount of abrasive material located along the upper and lower regions, shown as 92' and 94' is increased as compared to the pad of FIGS. 3A and 3B. The pad 180 (shown in FIGS. 12 and 13) further includes oval shaped apertures 72' that extend from a lower portion 74' to an upper portion 76' as discussed above with reference to FIGS. 3A and 3B.

The shoe 190 (shown in FIGS. 12 and 14) includes oval shaped apertures 82' as discussed above with reference to the shoe 80 of FIGS. 4A and 4B, which extend from a lower portion 84' to an upper portion 86' as shown. The back sides of the upper and lower regions 92', 94' of the pad 180 are attached, for example, via adhesive-backed Velcro sections 182 and 184, to hook structures 186 and 188. During use, the pad 180 may be attached to the shoe 190 by sliding the pad and hooks along rail protrusions 192, 194 on the shoe 190 such that the apertures 72' of the pad 180 align with the apertures 82' of the shoe 190. In further embodiments, the amount of alignment of the apertures may be adjusted from 100% down to no alignment of the apertures as may be suitable for any specific desired amount of cooling and debris removal from a material being processed on a roll 196.

The shoe 190 further includes an internal plenum 90' that is coupled to a vacuum line to provide vacuum through the apertures 82' of the shoe 190 and through the mutually aligned apertures 72' of the pad 180. One end of the shoe 190 is coupled to a vacuum line and one end may be capped, or both ends of the shoe 190 may be coupled to a common vacuum line or to two vacuum lines. In some embodiments, the ends of the pad may be covered with a flexible material that is closed to gas (e.g., a closed cell foam material), or in further embodiments the ends of the pad may be open or partially open as desired for specific cooling needs in certain applications. The pad and shoe arrangement of certain embodiments of the invention provides debris removal during cleaning as well as a desired amount of cooling.

The attachment system of FIGS. 12-14 allows the abrasive pad to be slid on or off the shoe 190, from the end of the machine. The hook structures 186, 188 may be fanned of synthetic or metallic material may be spaced apart, for example, every 10 to 14 inches. In further embodiments, the hook structures 186 and 188 may each include one structure only that itself extends the roll width. Those skilled in the art will appreciate that other similar designs using interlocking mechanical components are within the spirit of the invention relating to this embodiment. For example, instead of hook-shaped securing elements, T-shaped buttons or elements may be used in conjunction with a T-shaped slot in the shoe.

Figure 15:
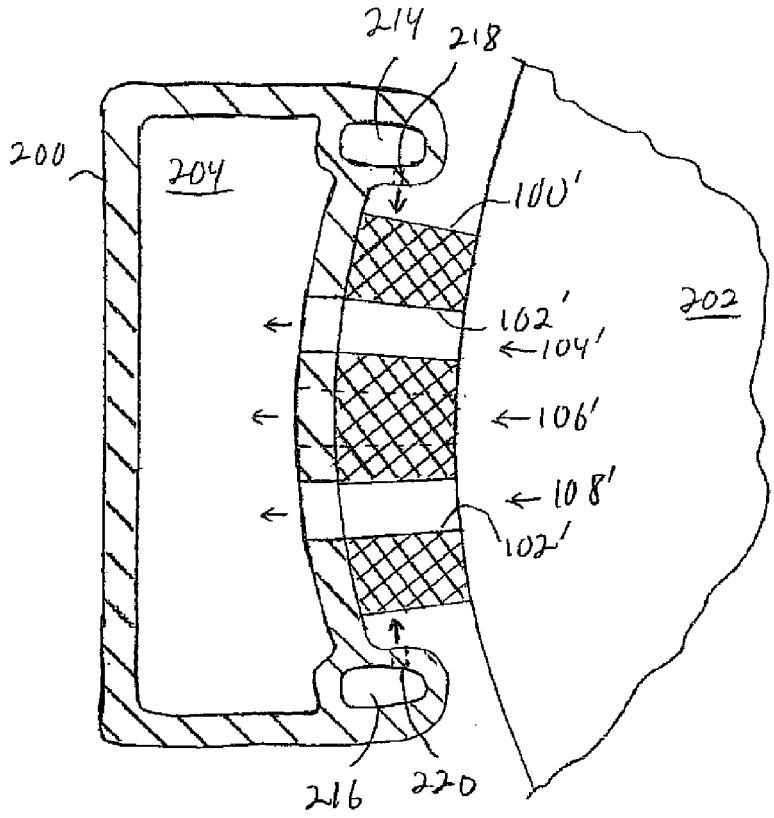
FIG. 15 shows a diagrammatic illustrative sectional side view of a cleaning pad and shoe in accordance with a further embodiment of the invention employing positive fluid pressure as well as a vacuum.
Figure 16:
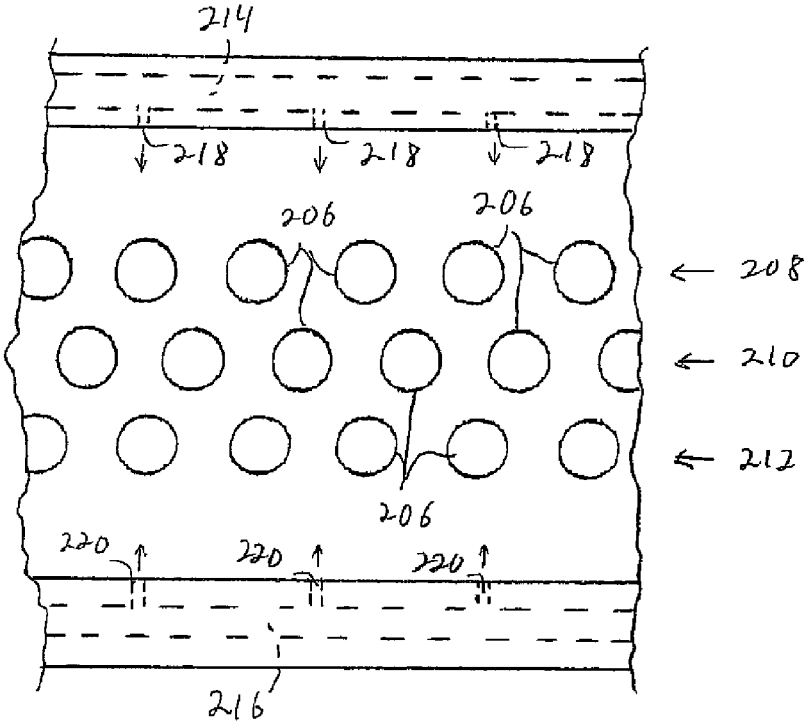
FIG. 16 shows a diagrammatic illustrative plan view of the shoe of FIG. 15.

FIGS. 15 and 16 show a pad and shoe arrangement in accordance with a further embodiment of the invention in which, in addition to the use of a vacuum, a fluid is provided under positive pressure to further assist in debris removal as well as pad cooling. In particular, a pad 100' having oval shaped apertures 102' in rows 104', 106' and 108' (similar to the pad 100 disclosed above with reference to FIGS. 5A and 5B) is mounted on a shoe 200 and applied to a roll 202. In further embodiments, the pad may include no apertures.

The shoe 200 further includes a first internal plenum 204 that is coupled to a vacuum line to provide vacuum through apertures 206 in the shoe 200 that are provided in rows 208, 210 and 212, and through the mutually aligned apertures 102' of the pad 100'. One end of the shoe 200 is coupled to a vacuum line and one end may be capped, or both ends of the shoe 200 may be coupled to a common vacuum line or to two vacuum lines. In some embodiments, the ends of the pad may be covered with a flexible material that is closed to gas (e.g., a closed cell foam material), or in further embodiments the ends of the pad may be open or partially open as desired for specific cooling needs in certain applications. The pad and shoe arrangement of certain embodiments of the invention provides debris removal during cleaning as well as a desired amount of cooling.

The shoe 200 further includes a second internal plenum 214 and a third internal plenum 216, each of which includes a small opening 218 and 220 respectively as shown. A fluid under pressure (such as water or pressurized air) is provided in the plenums 214, 216 to provide a flow the fluid through the pad 100' to assist in both removal of debris from the pad as well as cooling of the pad. The injection of this liquid or gas could be done continuously or intermittently. For example, a relatively high-pressure air (30 to 125 PSIG) may be injected into the pad on 15 minute intervals. Although FIG. 15 shows a shoe that has integral fluid chambers, it should be understood that these chambers (or tubes) could be separate components that are attached and secured with an appropriate fastening means.

Figure 17:
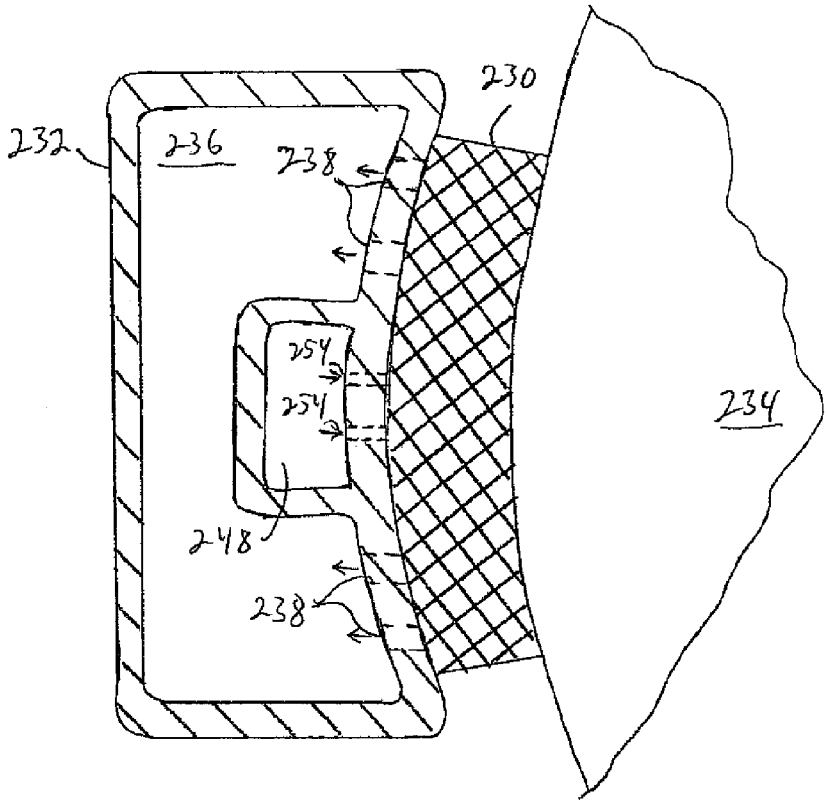
FIG. 17 shows a diagrammatic illustrative sectional side view of a cleaning pad and show in accordance with another embodiment of the invention employing positive fluid pressure as well as a vacuum.
Figure 18:
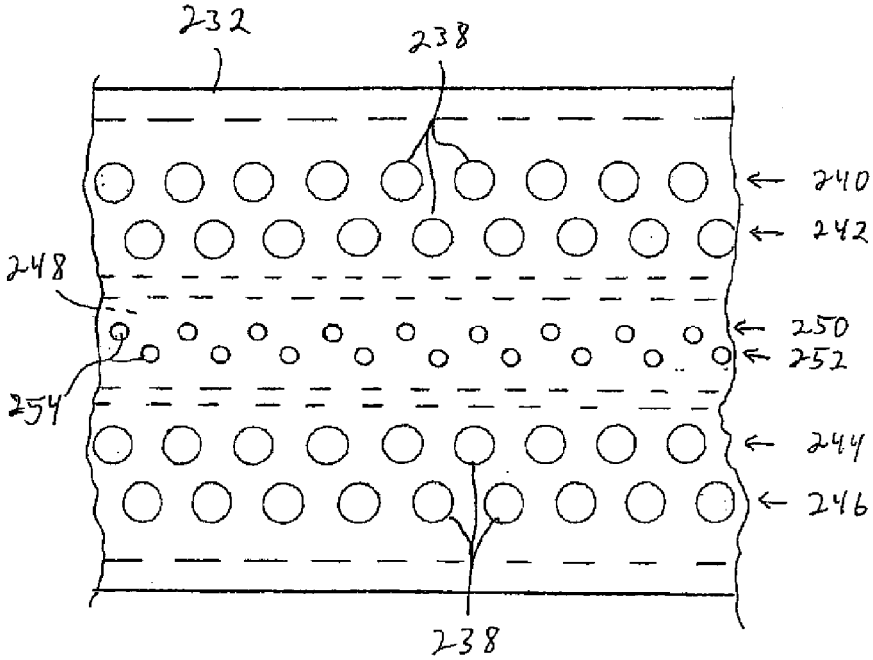
FIG. 18 shows a diagrammatic illustrative plan view of the shoe of FIG. 17.

FIGS. 17 and 18 show a pad and shoe arrangement in accordance with yet a further embodiment of the invention in which again, in addition to the use of a vacuum, a fluid is provided under positive pressure to further assist in debris removal as well as pad cooling. In particular, a pad 230 is mounted on a shoe 232 and applied to a roll 234. The pad 230 includes no apertures. The shoe 232 further includes a first internal plenum 236 that is coupled to a vacuum line to provide vacuum through apertures 238 in the shoe 232 that are provided in rows 240, 242, 244 and 246 and through the pad 230. One end of the shoe 200 is coupled to a vacuum line and one end may be capped, or both ends of the shoe 200 may be coupled to a common vacuum line or to two vacuum lines. In some embodiments, the ends of the pad may be covered with a flexible material that is closed to gas (e.g., a closed cell foam material), or in further embodiments the ends of the pad may be open or partially open as desired for specific cooling needs in certain applications. The pad and shoe arrangement of certain embodiments of the invention provides debris removal during cleaning as well as a desired amount of cooling.

The shoe 232 further includes a second internal plenum 248 that includes two rows 250 and 252 of small openings 254 as shown. A fluid under pressure (such as water or pressurized air) is provided in the plenum 248 to provide a flow the fluid through the pad 230 to assist in both removal of debris from the pad as well as cooling of the pad. Again, the injection of this liquid or gas could be done continuously or intermittently. For example, a relatively high-pressure air (30 to 125 PSIG) may be injected into the pad on 15 minute intervals. Although FIG. 17 shows a shoe that has integral fluid chambers, it should be understood that these chambers (or tubes) could be separate components that are attached and secured with an appropriate fastening means.

In further embodiments, other fluids under pressure may be used, such as steam, detergent solutions and various solvents. In further embodiments, the fluid under pressure may be used without also applying a vacuum. In accordance with further embodiments, integral temperature sensors may be used within an abrasive pad to alert operators to (or to automatically) unload the abrasive pad should the temperature exceed some pre-determined upper limit. High temperature sensing is important in order to prevent pre-mature failure of the abrasive pad material, transfer of pad material to the moving surface, or damage to the moving surface. The temperature sensors can be a thermo-couple or other suitable temperature sensor. The preferred arrangement is to have a temperature sensor attached to the interconnect wiring with a removal connector. As an alternative, the temperature sensor could transmit the data to a control system using wireless technology.

Those skilled in the art will appreciate that numerous modifications and variations may be made to the above disclosed embodiments without departing from the spirit and scope of the invention.

What is claimed is:

1. A cleaning apparatus for processing a moving surface, said cleaning apparatus comprising a pad that is attached to a support structure, wherein said pad is positioned to conform to a non-planar moving surface and includes a plurality of pad apertures wherein said plurality of said pad apertures each pass unobstructed directly from one side of the pad to another side of the pad, and wherein said support structure includes a plurality of support structure apertures, and further wherein a vacuum is provided proximate said plurality of support structure apertures and wherein pressurized air is provided through the pad under positive pressure, wherein said vacuum and pressurized air are provided for removing debris from a moving surface during use as well as for facilitating cooling of the pad during use, wherein an additional filter material is disposed between the pad and the support structure.

2. The cleaning apparatus as claimed in claim 1, wherein said plurality of pad apertures are aligned with the plurality of support structure apertures.

3. The cleaning apparatus as claimed in claim 1, wherein said plurality of pad apertures are positioned such that as a roll to which the pad is applied rotates, substantially each portion of the surface of the roll passes at least one of said plurality of pad apertures.

4. The cleaning apparatus as claimed in claim 1, wherein said pad is mounted on said support structure using at least one hook structure that is attached to the pad, wherein the hook structure may be slid along a mating connector portion of the support structure.

5. The cleaning apparatus as claimed in claim 1, wherein said cleaning apparatus includes at least two pads that are attached to the support structure.

6. The cleaning apparatus of claim 5, wherein a vacuum is provided directly to each of said pads for removing debris from a moving surface during use as well as for facilitating cooling of the pads during use.

7. The cleaning apparatus of claim 5, wherein said pads are positioned to substantially approximate a portion of an outer surface of a roll in a papermaking machine.

8. A cleaning apparatus for processing a moving surface, said cleaning apparatus comprising a pad that is attached to a support structure, wherein said support structure includes a plurality of support structure apertures, and further wherein said support structure is coupled to a vacuum line to provide a vacuum through said pad, wherein said support structure is coupled to a pressurized fluid means to provide positive fluid pressure through the pad for facilitating the removal of debris from a moving surface during use as well as for facilitating cooling of the pad during use, and wherein said fluid is pressurized air.

9. The cleaning apparatus as claimed in claim 8, wherein said fluid is directed toward the pad such that the fluid passes through the pad and is drawn by the vacuum.

10. The cleaning apparatus as claimed in claim 8, wherein said cleaning apparatus includes at least two pressurized fluid plenums for providing the fluid to the pad at a plurality of locations for facilitating the removal of debris from the moving surface during use as well as for facilitating cooling of the pad during use.

11. The cleaning apparatus as claimed in claim 8, wherein an additional filter material is disposed between the pad and the support structure.

12. A cleaning apparatus for processing a moving surface, said cleaning apparatus comprising at least one pad that is attached to a support structure, wherein said support structure includes pressurized gas means for providing a gas to the at least one pad for facilitating the removal of debris from the moving surface during use as well as for facilitating cooling of the pad during use.

13. The cleaning apparatus as claimed in claim 12, wherein said gas is pressurized air.

14. The cleaning apparatus as claimed in claim 12, wherein said support structure is coupled to a vacuum line to provide a vacuum proximate said pad for removing debris from the moving surface during use as well as for facilitating cooling of the pad during use.

15. The cleaning apparatus as claimed in claim 14, wherein said gas is directed toward the pad such that the gas passes through the pad and is drawn by the vacuum.

16. The cleaning apparatus as claimed in claim 14, wherein said pad includes a plurality of pad apertures and said support structure includes a plurality of support structure apertures, and further wherein pad apertures are aligned with said support structure apertures when the pad is mounted on the support structure for facilitating the removal of debris from the moving surface during use as well as for facilitating cooling of the pad during use.

17. The cleaning apparatus as claimed in claim 16, wherein said pad apertures are positioned such that as a roll of a papermaking machine to which the pad is applied rotates, substantially all of the surface of the roll passes at least one pad aperture.

18. The cleaning apparatus as claimed in claim 16, wherein said pad apertures are substantially aligned with said support structure apertures.

19. The cleaning apparatus as claimed in claim 12, wherein said support structure includes a plurality of apertures.

20. The cleaning apparatus as claimed in claim 14, wherein said pad includes a plurality of apertures.

21. The cleaning apparatus as claimed in claim 14, wherein said cleaning apparatus further includes an additional filter material that is disposed between the pad and the support structure.

22. The cleaning apparatus as claimed in claim 19, wherein said support structure is coupled to a vacuum line to provide a vacuum proximate said pad for removing debris from the moving surface during use as well as for facilitating cooling of the pad during use.

23. A cleaning apparatus for processing a moving surface, said cleaning apparatus comprising a pad that is attached to a support structure, wherein said support structure includes a plurality of support structure apertures, and further wherein said support structure is coupled to a vacuum line to provide a vacuum through said pad, wherein an additional filter material is disposed between said pad and said support structure, and wherein said support structure is coupled to a pressurized fluid means to provide positive fluid pressure through the pad for facilitating the removal of debris from a moving surface during use as well as for facilitating cooling of the pad during use.

24. The cleaning apparatus as claimed in claim 23, wherein said fluid is pressurized air.

25. The cleaning apparatus as claimed in claim 23, wherein said fluid is directed toward the pad such that the fluid passes through the pad and is drawn by the vacuum.

26. The cleaning apparatus as claimed in claim 23, wherein said cleaning apparatus includes at least two pressurized fluid plenums for providing the fluid to the pad at a plurality of locations for facilitating the removal of debris from the moving surface during use as well as for facilitating cooling of the pad during use.

* * * * *